US006402854B1

(12) United States Patent
Horridge

(10) Patent No.: US 6,402,854 B1
(45) Date of Patent: Jun. 11, 2002

(54) METHOD OF CLEANING THE INSIDE SURFACE OF DUCTS

(75) Inventor: Graham Horridge, East Sussex (GB)

(73) Assignee: System Hygienics Limited, East Sussex (GB)

( * ) Notice: Subject to any disclaimer, the term of this patent is extended or adjusted under 35 U.S.C. 154(b) by 0 days.

(21) Appl. No.: 09/623,671

(22) PCT Filed: Mar. 3, 1999

(86) PCT No.: PCT/GB99/00632

§ 371 (c)(1),
(2), (4) Date: Dec. 11, 2000

(87) PCT Pub. No.: WO99/46085

PCT Pub. Date: Sep. 16, 1999

(30) Foreign Application Priority Data

Mar. 9, 1998 (GB) ..... 9805047

(51) Int. Cl.[7] ..... B08B 7/00; B08B 9/00; B08B 9/027; B08B 9/04

(52) U.S. Cl. ..... 134/8; 134/6; 134/7; 134/22.1; 134/22.11; 134/24

(58) Field of Search ..... 134/6, 7, 8, 22.1, 134/22.11, 24

(56) References Cited

U.S. PATENT DOCUMENTS

| | | | | |
|---|---|---|---|---|
| 5,108,512 A | | 4/1992 | Goffnett | |
| 5,367,838 A | * | 11/1994 | Visaisouk et al. | 451/39 |

FOREIGN PATENT DOCUMENTS

| | | |
|---|---|---|
| DE | 4420579 A1 | 12/1995 |
| DE | 196 01 814 | 12/1996 |
| DE | 195 35 557 | 3/1997 |
| EP | 795 360 | 9/1997 |
| JP | 2-249999 | 5/1990 |
| SU | 588025 | 1/1978 |

* cited by examiner

*Primary Examiner*—Zeinab El-Arini
(74) *Attorney, Agent, or Firm*—Duane Morris LLP

(57) ABSTRACT

A method of cleaning the inside surface of a kitchen extraction duct or other grease duct, includes applying solid carbon dioxide under pressure to the inside surface of the duct, so that grease thereon is hardened and dislodged therefrom.

12 Claims, 1 Drawing Sheet

METHOD OF CLEANING THE INSIDE SURFACE OF DUCTS

This is a national stage application of PCT/GB99/00632 filed Mar. 3, 1999.

The present invention relates to a method of cleaning the inside surface of a kitchen extraction duct or other grease duct which often become coated with a layer of grease, which is very difficult to remove.

Present duct cleaning systems involve blasting compressed air through the ducts and this has proven to be very effective in removing dry dirt such as dust. It does not, however, achieve good results when used to remove grease and similar deposits. This problem is presently overcome by manually scraping and scrubbing the ducts, where access is possible, but it is still difficult to ensure that the duct surfaces are cleaned thoroughly. Manual cleaning also requires considerable effort and is significantly restricted by the lack of accessibility to the ducts. A build-up of grease in extraction ducts is a serious fire risk and possible health risk, and should be avoided.

An object of the present invention is to provide a method of cleaning the inside surface of a kitchen extraction duct or other grease duct which enables grease to be removed from the inside surface thereof without the need for cutting-in and installing the large numbers of access doors required for manual cleaning.

The present invention provides a method of cleaning the inside surface of a kitchen extraction duct or other grease duct by application of solid carbon dioxide under pressure, to harden and dislodge material as described herein.

BRIEF DESCRIPTION OF THE DRAWINGS

An embodiment of the invention will now be described, with reference to the accompanying drawings, wherein.

DETAILED DESCRIPTION OF THE PREFERRED EMBODIMENTS

Figure 1:
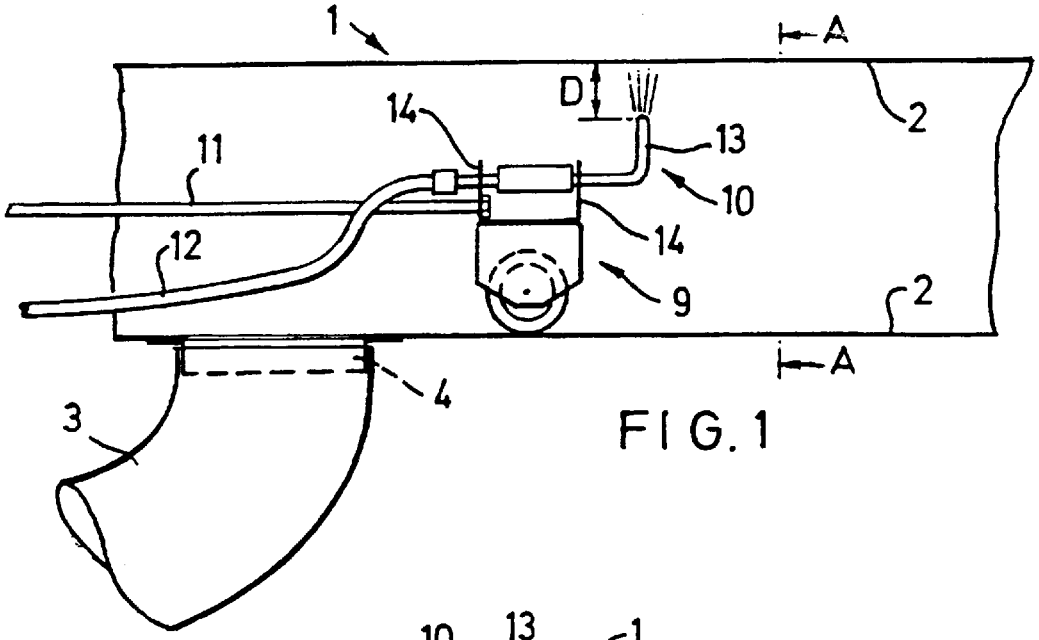
FIG. 1 is a sectional side view of a kitchen extraction duct illustrating a cleaning method according to the invention.
Figure 2:
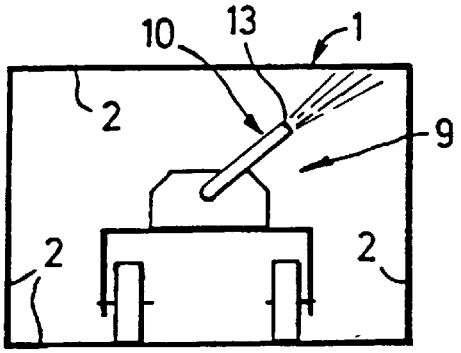
FIG. 2 is a section taken along line A—A of FIG. 1.
Figure 3:
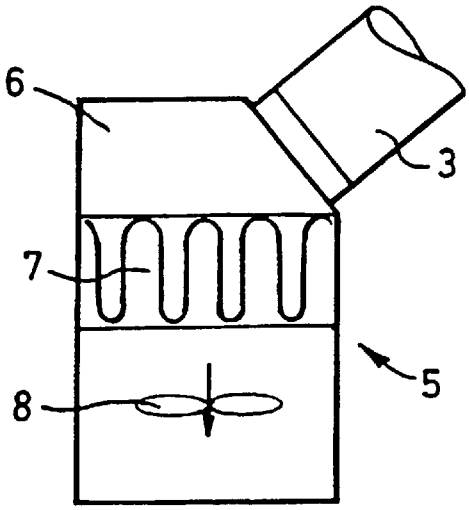
FIG. 3 is a part-secional diagrammatic view of an extraction unit for use with the extraction duct of FIG. 1.

In FIGS. 1 and 2 a kitchen extraction duct 1 has an inside surface 2 and a flexible outlet duct 3. The outlet duct 3 leads via an access door or panel 4 to an extraction unit 5 having a plenum 6, a filter 7, and an extraction fan 8, as shown in FIG. 3.

Apparatus for cleaning the inside surface 2 of the extraction duct 1 comprises a cleaning trolley 9 having a nozzle 10, a guide rod 11 and a hose 12. The trolley 9 is propelled along the duct 1 by means of the guide rod 11, which is controlled remotely from the surface being cleaned, eg from outside the extraction duct 1. The trolley 9 could be controlled by other remote means such as radio control, or it could be self-driven. For example, the trolley 9 could be equipped with a motor and be pre-programmed to travel slowly along the extraction duct 1 during cleaning, or to stop periodically to carry out cleaning.

Solid carbon dioxide is fed under pressure to the nozzle 10 via the hose 12, which leads from a solid carbon dioxide supply (not shown). This supply is preferably in the form of solid carbon dioxide granules. Solid carbon dioxide is then applied under pressure to the inside surface 2 of the extraction duct 1 through the nozzle 10. The thermal shock and the abrasive action caused by the blasting of the solid carbon dioxide through the nozzle 10 against the inside surface 2 of the extraction duct 1 hardens any grease on the surface 2 and dislodges it therefrom. The hardened grease flakes/particles are then more easily extracted, eg by suction, along the extraction duct 1 towards the outlet duct 3 which leads to the extraction unit 5 where they are collected in the filter 7, which can be emptied or exchanged periodically. Alternatively, the grease flakes/particles could be removed mechanically, eg by sweeping. The solid carbon dioxide sublimes, therefore leaving no excess residue to be removed from the extraction duct 1.

In order to optimise cleaning, a distance D, which is the distance between an expulsion end 13 of the nozzle 10 and the inside surface 2 of the extraction duct 1, is preferably as short as possible (about 15 cm or less).

Preferably, the nozzle 10 is rotatable so as to facilitate cleaning of all areas of the inside surface 2 of the extraction duct 1 and adjustably mounted on a support, eg on adjustable plates 14, so that the distance D may be maintained within the above recommended limit as the nozzle 10 is rotated.

The nozzle 10 may be interchangeable to permit cleaning of ducts of different diameters and cross sections.

Instead of a nozzle in the form of a right-angled arm as shown in FIGS. 1 and 2, the nozzle 10 could be circular with peripheral openings through which the dry ice would be blasted under pressure. To ensure cleaning of all the surfaces 2, such a circular nozzle should also be rotatable. Different diameter circular nozzles could be supplied depending on the diameter/cross section of the extraction duct 1.

The above-described cleaning method is particularly use fill in cleaning kitchen extraction ducts in restaurants or fast-food outlets, or any other ducts in which other sticky deposits occur.

What is claim is:

1. A method of cleaning the inside surface of a kitchen extraction duct, wherein solid carbon dioxide is applied under pressure to the inside surface of the duct so that grease thereon is hardened and dislodged therefrom.

2. A method as claimed in claim 1, wherein the solid carbon dioxide is in the form of granules.

3. A method as claimed in claim 1, wherein the solid carbon dioxide is supplied via a nozzle on a trolley moving along the inside of the duct.

4. A method as claimed in claim 3, wherein the movement of the trolley is controlled remotely.

5. A method as claimed in claim 3, wherein the nozzle is arranged as close as possible to the inside surface being cleaned.

6. A method as claimed in claim 3, wherein the nozzle is arranged at a distance of substantially 15 cm or less from the inside surface being cleaned.

7. A method as claimed in claim 3, wherein the nozzle is rotatably mounted on the trolley.

8. A method as claimed in claim 3, wherein the nozzle is interchangeable depending on a cross sectional size of the duct.

9. A method as claimed in claim 3, wherein the nozzle is adjustably mounted on the trolley to alter a distance of the nozzle from the inside surface of the duct.

10. A method as claimed in claim 3, wherein the nozzle is mounted on an adjustable support on the trolley.

11. A method as claimed in claim 3, wherein the trolley is self-driven.

12. A method as claimed in claim 1, wherein said cleaning of said inside surface is facilitated by thermal shock.

* * * * *